US007185879B1

(12) United States Patent
Lejuez

(10) Patent No.: US 7,185,879 B1
(45) Date of Patent: Mar. 6, 2007

(54) PRY BAR

(76) Inventor: Donald Lejuez, 30 Mechanic St., Milburn, NJ (US) 07041

( * ) Notice: Subject to any disclaimer, the term of this patent is extended or adjusted under 35 U.S.C. 154(b) by 0 days.

(21) Appl. No.: 11/332,096

(22) Filed: Jan. 13, 2006

(51) Int. Cl.
*B66F 15/00* (2006.01)

(52) U.S. Cl. ..... 254/25; 254/21

(58) Field of Classification Search ..... 254/25, 254/21, 18, 27
See application file for complete search history.

(56) References Cited

U.S. PATENT DOCUMENTS 176,053 A * 4/1876 Frank ..... 24/177
3,134,574 A * 5/1964 Reuterfors ..... 254/25
3,987,827 A * 10/1976 Mills ..... 81/45
5,695,171 A * 12/1997 Shine ..... 254/25
5,695,172 A * 12/1997 Hreha ..... 254/25

* cited by examiner

*Primary Examiner*—Lee D. Wilson

(57) ABSTRACT

A pry bar is disclosed. In one illustrative embodiment, the pry bar includes a body including a straight segment having a functional end segment, at least one notch provided in the functional end segment and a nail removal opening provided in the functional end segment adjacent to the at least one notch.

5 Claims, 3 Drawing Sheets

PRY BAR

FIELD

The present invention relates to prying tools. More particularly, the present invention relates to a pry bar which is suitable for prying asphalt shingles or cedar shakes from a roof adjacent to a step flashing without damaging the flashing.

BACKGROUND

On residential and commercial buildings, asphalt shingles or cedar shakes are typically secured to the roof of the building using nails. Periodic replacement of the shingles or cedar shakes typically involves prying of the securing nails from the roof. This is typically accomplished using the pry flanges of a hammer. However, in areas of the roof where a step flashing is attached to the roof, such as adjacent to a dormer, for example, the configuration of the hammer makes it difficult to remove nails from the roof and shingles or shakes without damaging the step flashing.

SUMMARY

The present invention is generally directed to a pry bar. In one illustrative embodiment, the pry bar includes a body including a straight segment having a functional end segment, at least one notch provided in the functional end segment and a nail removal opening provided in the functional end segment adjacent to the at least one notch.

BRIEF DESCRIPTION OF THE DRAWINGS

The invention will now be described, by way of example, with reference to the accompanying drawings, in which.

DETAILED DESCRIPTION

Figure 1:
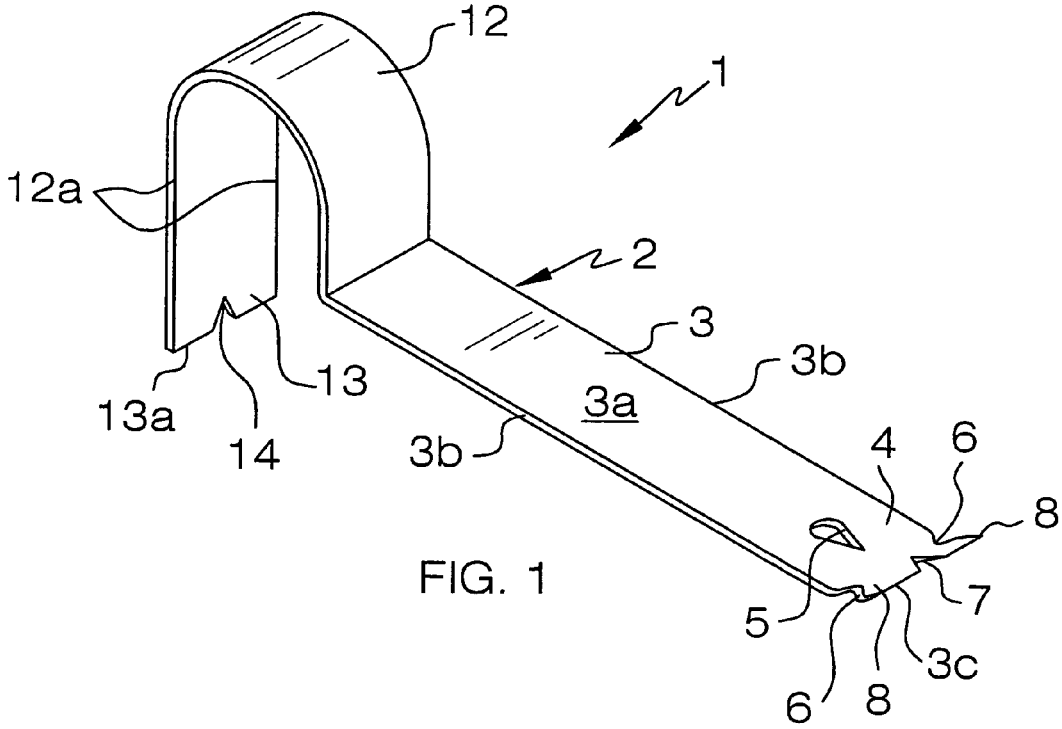
FIG. 1 is a perspective view of an illustrative embodiment of a pry bar according to the present invention.
Figure 2:
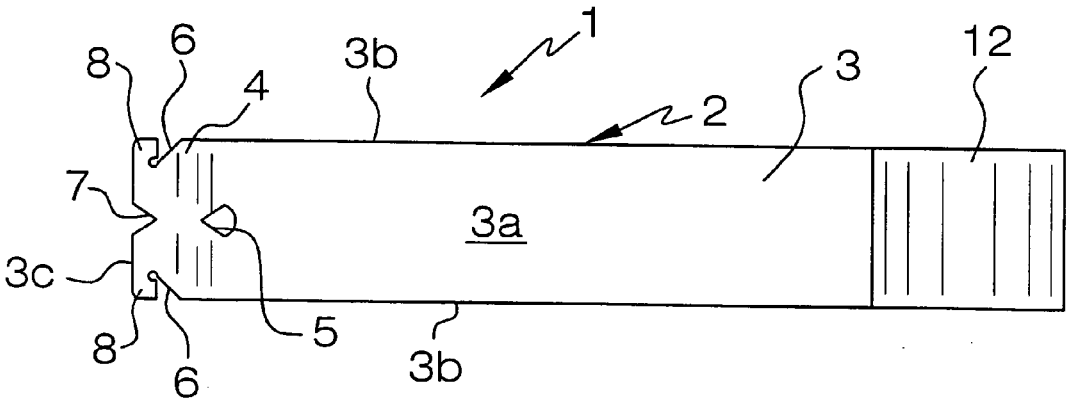
FIG. 2 is a top view of the pry bar shown in FIG. 1.
Figure 3:
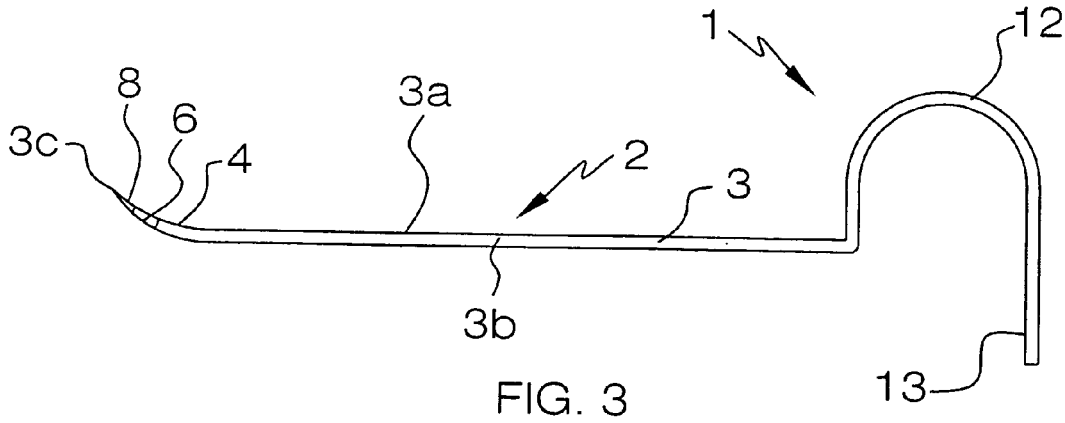
FIG. 3 is a side view of the pry bar shown in FIG. 1.

Referring initially to FIGS. 1–3 of the drawings, an illustrative embodiment of a pry bar according to the present invention is generally indicated by reference numeral 1. The pry bar 1 is typically steel, although alternative metals or materials may be used. The pry bar 1 includes a body 2 having an elongated straight segment 3 and a curved segment 12 provided on the straight segment 3. The straight segment 3 has a surface 3*a*, side edges 3*b*, a pry edge 3*c* and a functional end segment 4 which is opposite the curved segment 12. A nail removal opening 5, which may have a generally triangular or diamond shape, extends through the functional end segment 4 of the straight segment 3. Side notches 6 are provided in the opposite side edges of the straight segment 3 at the functional end segment 4. A center notch 7 is provided in the pry edge 3*c* of the straight segment 3, between the side notches 6. Accordingly, a side projection 8 is defined between each side notch 6 and the center notch 7. As shown in FIG. 3, the functional end segment 4 is disposed at a generally obtuse angle with respect to the surface 3*a* of the straight segment 3.

The curved segment 12 has side edges 12*a* and a functional end 13 which is opposite the straight segment 3 and has a pry edge 13*a*. A notch 14, which may have a generally triangular shape, is provided in the pry edge 13*a* of the functional end 13 of the curved segment 12. The notch 14 is suitable for prying a nail (not shown), in typical use of the pry bar 1 which will be hereinafter described.

In typical use, the pry bar 1 is suitable for removing nails (not shown) which secure asphalt shingles (not shown) or cedar shakes (not shown) to a roof on a building. The pry bar 1 is particularly suitable for removing nails from shingles or cedar shakes adjacent to a step flashing (not shown) without risk of damage to the step flashing. Accordingly, the user can grasp the curved segment 12 and one of the side notches 6 or the center notch 7 in the functional end segment 4 of the straight segment 3 can be inserted between the nail head and the shingle or shake and the nail partially pried from the roof and the shingle or shake by pushing downwardly on the curved segment 12 of the pry bar 1. The partially-pried nail can then be inserted through the nail removal opening 5 of the straight segment 3 and the curved segment 12 lifted to complete removal of the nail and unsecured shingle or shake from the roof. In some areas on the roof, it may be advantageous to pry the nail using the notch 14 on the pry edge 13*a* of the functional end 13 of the curved segment 12 as the user grips the straight segment 3.

Figure 4:
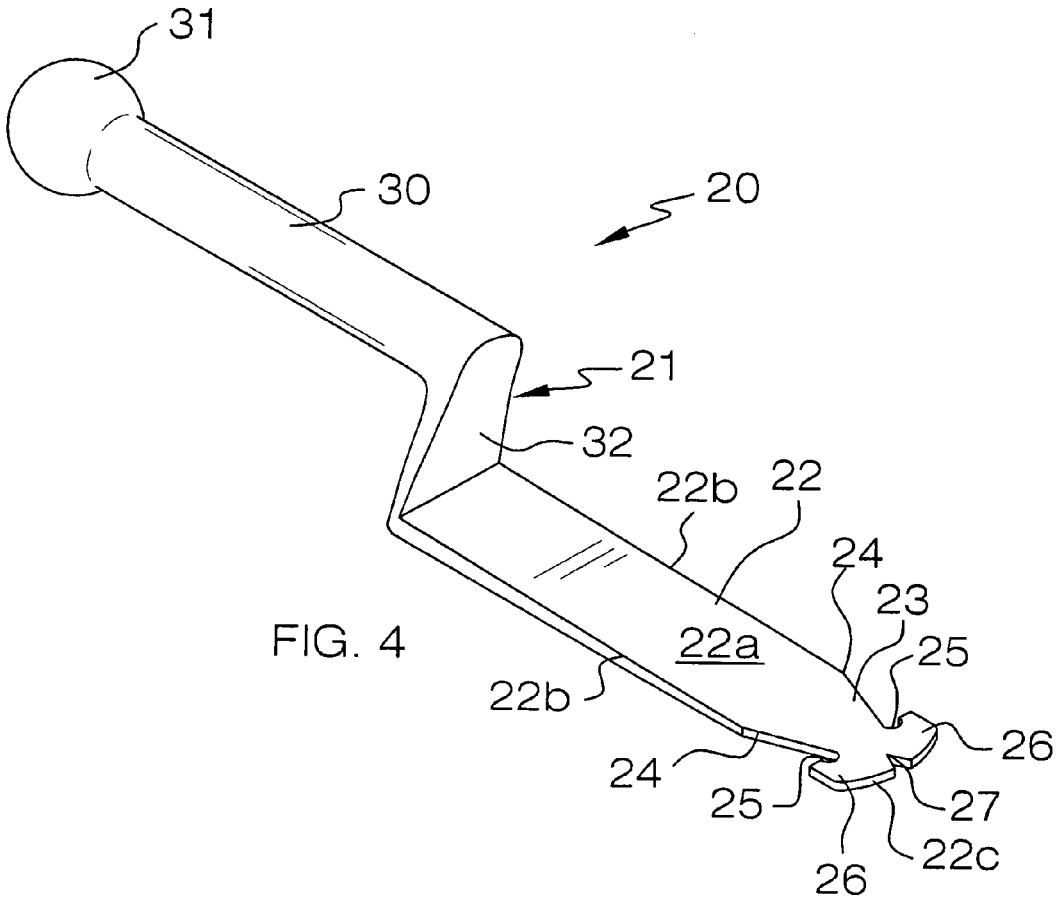
FIG. 4 is a perspective view of an alternative illustrative embodiment of a pry bar according to the present invention.
Figure 5:
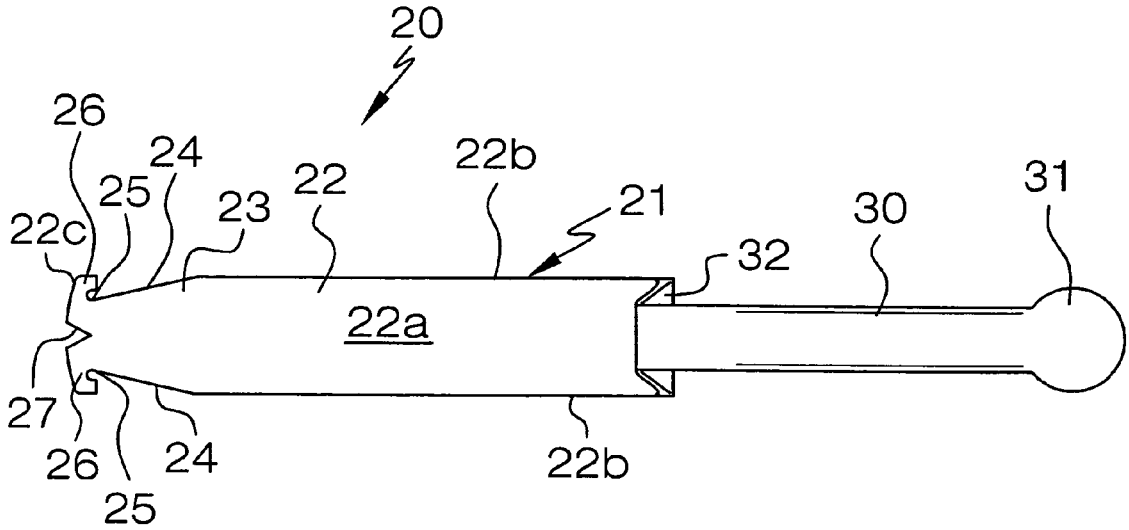
FIG. 5 is a top view of the pry bar shown in FIG. 4.
Figure 6:
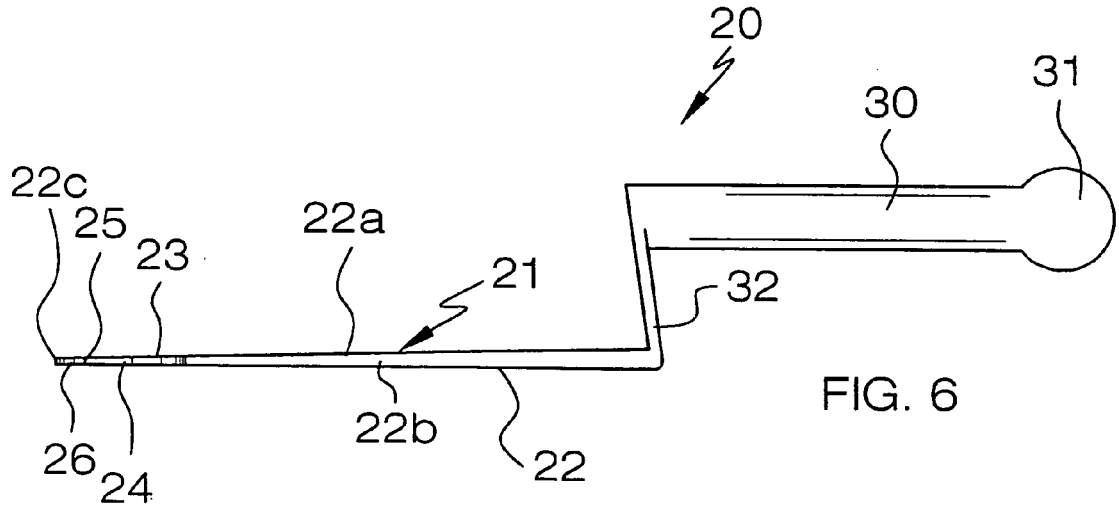
FIG. 6 is a side view of the pry bar shown in FIG. 4.

Referring next to FIGS. 4–6 of the drawings, an alternative illustrative embodiment of a pry bar according to the present invention is generally indicated by reference numeral 20. The pry bar 20 is typically steel, although alternative metals or materials may be used. The pry bar 20 includes a body 21 which includes a straight segment 22 and a handle segment 30 provided on the straight segment 22. A connecting segment 32 connects the straight segment 22 to the handle segment 30. The straight segment 22 and the handle segment 30 are typically disposed in offset relationship to each other. A handle ball 31 may be provided on the handle segment 30, opposite the connecting segment 32.

The straight segment 22 has a surface 22*a*, side edges 22*b*, a pry edge 22*c* and a functional end segment 23 opposite the handle segment 30. The functional end segment 23 typically includes a pair of tapered edges 24 which angle into the straight segment 22 from the respective side edges 22*b*. Side notches 25 are defined by the tapered edges 24 in the functional end segment 23. Side projections 26 extend from opposite edges of the functional end segment 23, adjacent to the respective side notches 25. A center notch 27 is provided between the side projections 26.

In typical use, the pry bar 20 is suitable for removing nails (not shown) which secure asphalt shingles (not shown) or cedar shakes (not shown) to a roof on a building and is particularly suitable for removing nails from shingles or cedar shakes adjacent to a step flashing (not shown) without risk of damage to the step flashing. Accordingly, the user can grasp the handle segment 30 and one of the side notches 25 or the center notch 27 in the functional end segment 23 of the straight segment 22 can be inserted between the nail head and the shingle or shake and the nail pried from the roof and the shingle or shake by pushing downwardly on the handle segment 30 of the pry bar 1. The unsecured shingle or shake is then removed from the roof.

While the preferred embodiments of the invention have been described above, it will be recognized and understood that various modifications can be made in the invention and the appended claims are intended to cover all such modifications which may fall within the spirit and scope of the invention.

What is claimed is:

1. A pry bar, comprising:

a body including a straight segment having side edges and a surface and a functional end segment having a pry edge;

a pair of side notches provided in said pry edge of said functional end segment;

a generally diamond-shaped nail removal opening provided in said functional end segment adjacent to said pair of side notches; and a curved segment extending from said straight segment opposite said functional end segment.

2. The pry bar of claim 1 further comprising a notch provided in said curved end segment.

3. The pry bar of claim 1 further comprising a center notch provided in said pry edge of said functional end segment between said pair of side notches.

4. The pry bar of claim 3 further comprising a pair of side projections provided in said side edges, respectively, of said straight segment at said functional end segment between said center notch and each of said pair of side notches.

5. The pry bar of claim 1 wherein said functional end segment is disposed at an obtuse angle with respect to said straight segment.

* * * * *